United States Patent [19]

Sun

[11] Patent Number: 4,712,644

[45] Date of Patent: Dec. 15, 1987

[54] EXHAUST SILENCER FOR INTERNAL COMBUSTION ENGINES

[76] Inventor: Yichang Sun, 25 Zhang Zizhong Rod., Tianjin, China

[21] Appl. No.: 839,062

[22] Filed: Mar. 13, 1986

[30] Foreign Application Priority Data

Apr. 1, 1985 [CN] China ..... 85102410

[51] Int. Cl.[4] ..... F01N 1/10

[52] U.S. Cl. ..... 181/251; 181/256; 181/268; 181/272; 181/275

[58] Field of Search ..... 181/251, 268, 275, 272, 181/256

[56] References Cited

U.S. PATENT DOCUMENTS

| | | | |
|---|---|---|---|
| 1,740,805 | 12/1929 | Brice | 181/251 |
| 2,019,697 | 11/1935 | Smith | 181/251 X |
| 4,180,141 | 12/1979 | Judd | 181/268 X |
| 4,203,503 | 5/1980 | Franco et al. | 181/272 |
| 4,209,076 | 6/1980 | Franco et al. | 181/272 |
| 4,392,549 | 7/1983 | Wrobel et al. | 181/268 X |

*Primary Examiner*—Benjamin R. Fuller

*Attorney, Agent, or Firm*—Darby & Darby

[57] ABSTRACT

An exhaust silencer for internal combustion engines, particularly as used on motor vehicles including tractors. A front pipe, a plurality of core tubes and a tail pipe have successive inner flow channels of equal section areas. The plurality of core tubes are integrally connected to the larger end of a trumpet pipe. The walls of the core tubes are punched with flanged holes forming converging passages. Flow-dividing plates are provided in the tail pipe. The exhaust flow divides into smaller substreams on passing through the front pipe and the core tubes, thus raising the ratio of expansion, leading to a decrease in noise level and exhaust back pressure, while reducing engine output loss. The noise level of a vehicle can be reduced to 80–83 dB(A), while oil consumption is reduced by 6–8.8%.

12 Claims, 6 Drawing Figures

EXHAUST SILENCER FOR INTERNAL COMBUSTION ENGINES

The present invention relates to an exhaust silencer for internal conbustion engines, especially for those used on motor vehicles and tractors.

At present, exhaust silencers used on motor vehicles and tractors work generally on the principle of consuming the energy of exhaust flows and equalizing fluctuations of the exhaust pressure. Therefor, silencers are commonly designed into such structures that make exhaust flows pass through a series of channels having reducing and expanding sections repeatedly, with frequent flow direction changs, or divide the exhaust flow into smaller streams flowing along rough surfaces. Such strutures did reduce noises to some extent. However, the backpressure of the exhaust tends to increase due to the blocked exhaust flow. The faster the engine runs, the greater the exhaust flow resistance will be, consequently the more loss of power output, and more fuel consumption. When an engine runs at its maximum speed, the loss of its power output due to the above causes can be as high as 5–10%. There is wide interest in providing a silencer have good performance with little influence on engine output is widely concerned.

The U.S. Pat. No. 4,203,503 and U.S. Pat. No. 4,209,076 disclosed a type of exhaust silencer, in which exhaust flows first enter a resonant cavity which absorbs sound energy, then enter an expansion cavity to expend the sound energy further, finally go out into the atmosphere. But in a silencer of such a type, exhaust flows are still blocked, exhaust flow resistance remains relatively large, thus the noise depressing effect and the saving of engine power output can not reach the desired level.

The object of the present invention is to provide for motor vehicles and tractors an exhaust silencer of a low backpressure type that reduces noises across a wide band and keeps fuel consumption relatively low.

According to the present invention, an exhaust silencer for motor vehicles and tractors has a cylindrical shell which is sealed at its both ends by a front lid and a rear lid, and the inside of which is divided by spacers into several separate chambers of different volumes, on each of the said lids an opening is formed for fixing a trumpet-like diverging pipe and tail pipe respectively, the geometric central axises of the said openings being identical with the axis of the cylindrical shell. The said trumpet pipe is either connected to a front pipe or integrally made therewith. Inside the cylindrical shell there are a group of core tubes, the walls of which are punched with flanged holes forming converging passages for communicating the inner channels of the tubes with the chambers. Each of the core tubes extends from a front chamber to a rear chamber through the spacers via a series of corresponding holes, which are equally arranged along circles having aligned centers and a common diameter on every spacer. In the front and rear chambers the core tubes deflect gradually inwardly toward section centers of the bigger end of the trumpet pipe and the front end of the tail pipe at inclining angles of 3°–5° and 5°–10° respectively. The ends of the deflected portions of each core tubes are adapted to have sectorial cross sections and are assembled together, so as to be inserted directly into the bigger end of the trumpet to form an integral counection therewith in the front chamber, and to be connected with the front end of the tail pipe and the rear lid plane in the rear chamber. The front pipe, the bunch of the core tubes, and tail pipe having successive inner flow channels of substantially equal cross section areas. The outlet edge of the tail pipe has substantially a sinewave profile, inside the tail pipe there are disposed some flow-dividing plates.

The exhaust gases discharged from the engine exhaust pipe pass through the front pipe of the silencer, then flow into the core tubes via the corresponding end openings of sectorial cross sections thereof by dividing the main flow into several smaller streams. By the principle of resistance silencing, when exhaust flows reach the flanged holes on each core tubes, sound waves are reflected backwardly to sound sources, thus suppressing the noise. Dividing the main flow into thinner substreams enables the ratio of expansion to rise greatly, and via the openings of the flanged holes on the core tubes small streams of exhausts flow into and from the said chambers in which the core tubes extend, causing the pressure of the exhaust flows to change greatly, too. The above said two desirable facts contribute not only to increase considerably the degree of noise reduction but to decrease the smoke density of the exhausts as well. The latter benifit is obtained because the soots in the exhaust flows deposit down to the chambers on their way through the punched portions of the core tubes as a result of expansion and centrifugalization of the flows at the openings of the flanged holes. In order to depress noises of middle and low frequencies, resonant chambers with different volumes are provided, while a certain volume of sound-absorbing material is provided in the last chamber to fill the space around the punched portions of the core tubes extending therethrough, so as to depress the high-frequency component of noises effectively. The punches on the walls of the core tubes have flanges which form passages converging outwardly to the chambers and which help to keep the flow resistance of the inner walls of the core tubes relatively low. The flow-dividing plates disposed in the tail pipe are used mainly to prevent resonance that might otherwise happen when exhaust flows are accumulating. The outlet of the tail pipe has an edge of substantially sinewave profile, which helps to discharge the exhausts into the atmosphere evenly.

The present invention is advantageous in that:

1. The fact that the front pipe, the bunch of the core tubes, and the tail pipe have successive inner flow channels of substantially equal cross section areas assures the discharge of exhausts to take place at a substantially constant flow rate, enabling reduction of losses induced by the high exhaust back-pressure, and hence the reduction in the loss of engine output and in oil consumption.
2. The exhaust flows divide into substreams by flowing through a bundle of core tubes instead of flowing through a single tube, thus reducing the noise level effectively.
3. Since the exhausts flow freely and continually through the inner chambers, and the soots in the exhausts diffuse into the inner chambers of the silencer on their way through the punched portions of the core tubes, the effect of off-engine cleaning of exhausts can be obtained, with the smoke density of exhausts considerably decreased.
4. The punches on the walls of the core tubes are so shaped that their flanges form passages converging radially outwardly, thus the inner walls of the core tubes are generally smooth, which have relatively low resistance and enable substantially free flows of exhausts.

5. The ability of allowing exhausts to flow continually at substantially constant volume rates extends the service lives of silencers and enables engines to run in good working cycles.

Some performance data of the silencers according to the present invention are listed in the Table I, in which is shown a comparision of noise levels and fuel consumptions between the silencers made according to the present invention and silencers of conventional types, testing on Jie. Fang CA-10B trucks, load capacity 4 ton.

TABLE I

| Silencer Type | Noise Level (whole truck) dB (A) | Fuel Consumptions (1/Km) 30 Km/h. | 40 Km/h. | 50 Km/h. |
|---|---|---|---|---|
| Conventional | 87–91 | 26.08 | 26.32 | 29.06 |
| Present Invention | 80–83 | 25.64 | 25.67 | 26.50 |
| | Saving of Fuel | 0.44 | 0.65 | 2.56 |
| | Ratio of Fuel Saving | 1.6% | 2.4% | 8.8% |

Now, a prefered embodiment of the present invention will be described in detail by refering to the following drawings.

Figure 1:
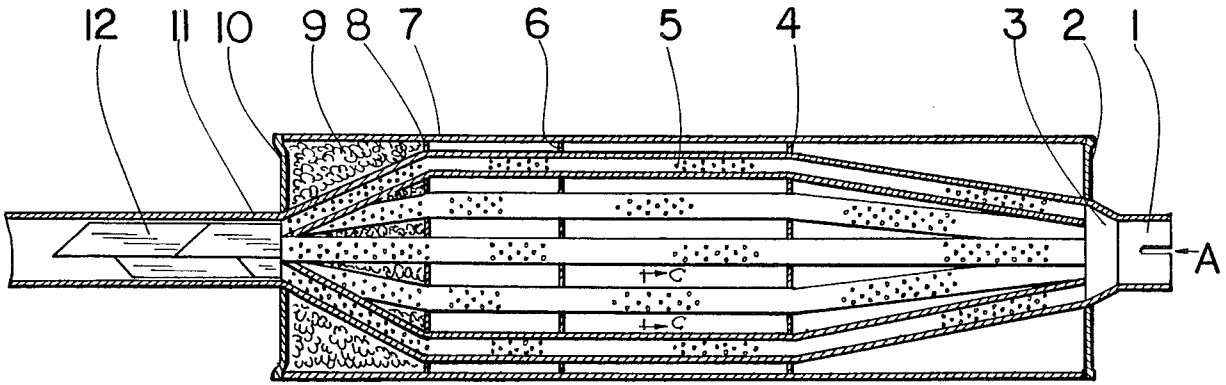
FIG. 1 is a longitudinal section view taken from a silencer of the type according to the present invention, having 4 chambers and 8 core tubes.
Figure 4:
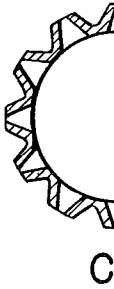
FIG. 4 is a cross section of a core tube, taken from the section C—C in FIG. 1, showing the flanged holes on the tube wall.
Figure 3:
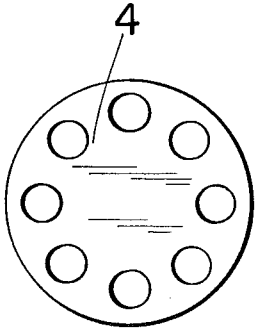
FIG. 3 is a plan view of a spacer, showing the arrangement of openings for core tubes.
Figure 2:
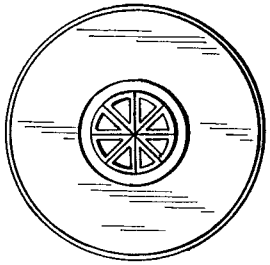
FIG. 2 is an end view taken along the arrow A in the FIG. 1, showing the assembly of the sectorial sectional ends of the core tubes at the connected portion of trumpet pipe and front pipe.
Figure 5:
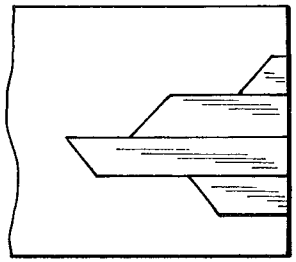
FIG. 5 is a development of the tail pipe, showing the arrangement of flow-dividing plates therein, and a sinewave profile at the outlet edge thereof.
Figure 6:
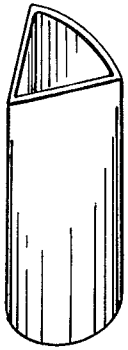
FIG. 6 is a perspective view of an end portion of core tube, showing the sectorial section thereof.

Refer now to FIG. 1, in which a silencer embodying the present invention is shown, the said silencer has 4 chambers and 8 core tubes therefor:

The rear end of the front pipe 1 of a diameter $D_1$ is welded to the smaller end of the trumpet pipe 3. The ends of eight core tubes 5 of a diameter d are assembled together and inserted directly into the bigger end of the trumpet pipe 3 and welded therewith, with the channel in the trumpet pipe 3 being divided into eight sub-channels of sectorial sections by the correspondingly shaped ends of the eight core tubes 5, accordingly. From the welded point the eight core tubes 5 depart from each other and extend radially forwardly to the front spacer 4, each at an inclining angle of 3°–5° with respect to the longitudinal axis of the cylindrical shell, then the eight tubes 5 deflect to the direction parallel to the longitudinal axis of the cylindrical shell and extend further through the openings correspondingly formed on each of the front spacer 4, middle spacer 6, and rear spacer 8. From the rear spacer 8 the eight core tubes deflect and extend toward the longitudinal axis of the shell at an inclining angle of 5°–10°, and finally meet with one another at the entrance of the tail pipe 11, with their end of sectorial sections being assembled together and welded to the corresponding edges of the flow-dividing plates 12 disposed in the tail pipe 11. The flow-dividing plates 12 consist of eight flat plates, the dimensions of each plates are so determined that when they extend longitudinally in the tail pipe 11 with their front end edges welded to the ends of the core tubes 5, their rear end edges lie in a predetermined spiral surface, and their longitudinal edges keep apart from the inner wall of the tail pipe 11 by a small gap. The tail pipe 11 has a diameter $D_2$, the outlet edge of the development of the pipe 11 has substantially a sinewave profile.

The walls of each the core tubes 5 are punched with holes, the ratio of the punched area to the wall surface area of each tube is 30%–50%. Said holes have flanges forming passages converging radially outwardly to the chambers inside the cylindrical shell, and in the said chambers groups of the said holes on each core tube 5 are axially staggered to those on the adjacent core tubes, all of the said core tubes 5 extend through the openings uniformly arranged along circles having aligned centers and a common diameter on each spacer (4,6,8).

The front pipe 1, the bunch of the eight core tubes 5, and the tail pipe 11 are so dimensioned that the cross section areas of their inner channels have substantially the following relation:

$$\frac{\pi}{4} D_1^2 \doteq 8 \times \frac{\pi}{4} d^2 \doteq \frac{\pi}{4} D_2^2$$

According to the best mode of the present invention, it is advantageous to have $D_1 = D_2 = 60$ mm.

and $d = 22$ mm.

The assembly described above is disposed in the cylindrical shell 7, the front end and rear end thereof are closed by the front lid 2 and the rear lid 10, respectively. The rear chamber, i.e. the one between the rear spacer 8 and the rear lid 10 is filled with sound-absorbing materials 9, such as glass wool.

The noise level of a truck having a load capacity of 4–5 tons is decreased to 80–83 dB (A) when the truck is equipped with the silencer of the type according to the present invenion. In addition, because the silencer of the present invention assures a relatively low exhaust back pressure, the loss of power output is reduced, hence there is lower oil consumption (see Table 1). Further, the smoke density and pollutant emissions are also reduced.

What is claimed is:

1. An exhaust silencer for an internal combustion engine having an exhaust pipe, comprising:

a cylindrical shell, said shell having first and second ends, an inner space therebetween and a longitudinal axis;

first and second lids disposed at said first and second ends, respectively, closing said cylindrical shell;

at least one substantially circular spacer dividing said inner space into a plurality of chambers, said chambers having different volumes, said spacer having a plurality of substantially circular openings therein uniformly and circumferentially disposed within said spacer;

front and tail pipes, said tail pipe having a front end including a geometric center and further having an outlet edge having an approximately sinewave profile;

a trumpet pipe having large and small ends, said large end having a geometric center, said front pipe being coupled to said trumpet pipe small end, and said trumpet pipe large end being coupled to said first lid;

said first and second lids each having an aperture for fitting therein said trumpet pipe large end and tail pipe, respectively, said apertures further having geometric centers, said geometric centers being aligned with said longitudinal axis;

a plurality of core tubes extending through said substantially circular openings in said spacer, said core tubes including first and second ends, said ends having cross sections substantially defining a sector of a circle, said core tubes having walls with holes therein coupling the interior volume of said core tubes to said chambers, said core tube holes having flanges;

said core tubes each including a portion parallel to said longitudinal axis and first and second portions deflecting at first and second angles toward the centers of the large end of said trumpet pipe and the front end of said tail pipe, respectively, said first ends of said core tubes being assembled together and inserted into said trumpet pipe large end to form an integral connection therewith; and flow dividing plates disposed in said tail pipe.

2. The exhaust silencer according to claim 1 comprising at least two spacers, each having substantially circular openings therein uniformly and circumferentially disposed within said spacers, said openings within each of said spacers having centers aligned with each other.

3. The exhaust silencer according to claim 2 wherein said first angle is in the range of 3 to 5 degrees, and said second angle is in the range of 5 to 10 degrees.

4. A silencer according to claim 3, characterized in that the front pipe, said plurality of core tubes, and the tail pipe have successive inner flow channels of substantially equal cross section areas.

5. A silencer according to claim 3 or 2, wherein at least one said spacer defines a rear chamber, said rear chamber being filled with sound-absorbing materials.

6. A silencer according to claim 3 or 4, characterized in that each of the flanged holes on the walls of the core tubes forms a radially outwardly converging passage.

7. A silencer according to claim 5, characterized in that each of the flanged holes on the walls of the core tubes forms a radially outwardly converging passage.

8. A silencer according to claim 6, characterized in that said flanged holes on each of the core tubes are staggered axially with respect to those on adjacent core tubes in each of said chambers, said core tubes each extending through said spacers via corresponding openings uniformly arranged along circles having aligned centers and a common diameter.

9. A silencer according to claim 7, characterized in that said flanged holes on each of the core tubes are staggered axially with respect to those on adjacent core tubes in each of said chambers, said core tubes each extending through said spacers via corresponding openings uniformly arranged along circles having aligned centers and a common diameter.

10. A silencer according to claim 8 or 9, wherein a ratio of an area of the holes to a surface area of the wall of each core tube is in the range of 30%–50%.

11. A silencer according to claim 9, wherein each of the flanged holes on the walls of the core tubes forms a radially outwardly converging passage.

12. A silencer according to claim 11, wherein a ratio of an area of the holes to a surface area of the wall of each core tube is in the range of 30%–50%.

* * * * *